United States Patent [19]

Burk, Jr. et al.

[11] 4,105,416

[45] Aug. 8, 1978

[54] PROCESS FOR REMOVING SULFUR FROM COAL

[75] Inventors: Emmett H. Burk, Jr., Glenwood; Jin S. Yoo, South Holland; John A. Karch, Chicago, all of Ill.

[73] Assignee: Atlantic Richfield Company, Philadelphia, Pa.

[21] Appl. No.: 786,911

[22] Filed: Apr. 12, 1977

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 3,454,363 | 7/1969 | Rieve | 201/17 X |
| 3,779,722 | 12/1973 | Tatum | 44/1 R |
| 3,824,084 | 7/1974 | Dillon et al. | 44/1 R |

*Primary Examiner*—Carl F. Dees

*Attorney, Agent, or Firm*—John B. Goodman

[57] ABSTRACT

A process for reducing the sulfur content of coal comprising the steps of:

(1) contacting coal particles with an aqueous solution of iron complexing agent, and an oxidant to preferentially oxidize at least a portion of the sulfur in the coal;

(2) contacting the oxidized sulfur-containing coal with at least one hydrogen donor material capable of transferring hydrogen to the oxidized sulfur-containing coal under conditions such that hydrogen transfer occurs; and (3) recovering coal products of reduced sulfur content.

23 Claims, No Drawings

PROCESS FOR REMOVING SULFUR FROM COAL

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coals are known to be rich in pyritic and organic sulfur. Generally, the pyritic sulfur represents from about 25% to 70% of the total sulfur content in these coals.

Heretofore, it was recognized that it would be highly desirable to remove (or at least lower) the sulfur content of coal prior to combustion. In this regard, a number of processes have been suggested for reducing the inorganic (pyritic) portion of the sulfur in coal.

For example, it is known that at least some pyritic sulfur can be physically removed from coal by grinding the coal, and subjecting the ground coal to froth flotation or washing processes. While such processes can desirably remove some pyritic sulfur and ash from the coal, these processes are not fully satisfactory because a significant portion of the pyritic sulfur is not removed. Attempts to increase the portion of pyritic sulfur removed have not been successful because these processes are not sufficiently selective. Because the process is not sufficiently selective, attempts to increase pyrite removal can result in a large portion of coal being discarded along with ash and pyrite. Organic sulfur cannot be physically removed from coal.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3+FeS_2 \rightarrow 3FeCl_2+S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal. In addition, this process is notably deficient in that it cannot remove organic sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2+H_2O+7/2O_2 \rightarrow FeSo_4+H_2SO_4$$

$$2FeSO_4+H_2SO_4+\tfrac{1}{2}O_2 \rightarrow Fe_2(SO_4)_3+H_2O$$

These reaction equations indicate that in this particular process the pyritic sulfur content continues to be associated with the iron as sulfate. While it apparently does not always occur, a disadvantage of this is that insoluble material, basic ferric sulfate, can be formed. When this occurs, a discrete separate separation procedure must be employed to remove this solid material from the coal solids to adequately reduce sulfur content. Several other factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount and/or heating value of the coal recovered from the process is decreased. The patent makes no claim that the process can remove organic sulfur from coal.

Numerous other methods have been proposed for reducing the pyritic sulfur content of coal. For example, U.S. Pat. No. 3,938,966, to Kindig et al, issued Feb. 17, 1976, discloses treating coal with iron carbonyl to enhance the magnetic susceptibility of iron pyrites to permit removal with magnets. This process is clearly directed to removing only pyritic sulfur from coal.

While there are disadvantages associated with the prior art processes for removing pyritic sulfur from coal, the prior art process can provide a significant reduction in pyritic sulfur. A notable deficiency of these prior processes is that they do not provide a significant reduction in the organic sulfur content of coal. Organic sulfur can often represent a significant portion of the total sulfur content of coal.

A more effective method for reducing the sulfur content of coal would involve effectively reducing both the pyritic sulfur and organic sulfur content of coal.

In summary, while the problem of reducing the sulfur content of coal has received much attention, there still exists a present need for a practical method to more effectively reduce the sulfur content of coal.

SUMMARY OF THE INVENTION

This invention provides a practical method for more effectively reducing the sulfur content of coal. In summary, this invention involves a process for reducing the sulfur content of coal comprising the steps of:

(1) contacting coal particles with an aqueous solution of iron complexing agent and an oxidant to preferentially oxidize at least a portion of the sulfur in the coal;

(2) contacting the oxidized sulfur-containing coal with at least one hydrogen donor material capable of transferring hydrogen to the oxidized sulfur-containing coal under conditions such that hydrogen transfer occurs; and (3) recovering coal products of reduced sulfur content.

It has been discovered that contacting sulfur-containing coal with an aqueous solution containing an iron complexing agent and an oxidant provides rapid oxidation of sulfur (reducing processing time) and more selective oxidation of sulfur compounds. In the course of this oxidation, pyritic sulfur can be removed. It has further been discovered that when this oxidized sulfur-containing coal is contacted with hydrogen donor material under conditions such that hydrogen transfer occurs that substantial removal of remaining pyritic sulfur is obtained and significant organic sulfur removal is obtained. A process is, therefore, provided which can reduce both the pyritic and organic sulfur content of coal.

DETAILED DESCRIPTION OF THE INVENTION AND ITS PREFERRED EMBODIMENTS

In its broad aspect, this invention provides a method for reducing the sulfur content of coal by a process comprising the steps of:

(1) contacting coal particles with an aqueous solution of iron complexing agent and an oxidant to preferentially oxidize at least a portion of the sulfur in the coal;

(2) contacting the oxidized sulfur-containing coal with at least one hydrogen donor material capable of transferring hydrogen to the oxidized sulfur-containing coal under conditions such that hydrogen transfer occurs; and (3) recovering coal products of reduced sulfur content.

The novel process of this invention can substantially reduce the pyritic sulfur content of coal. A notable advantage of the process is that it can also provide a reduction in the organic sulfur content of coal.

Suitable coals which can be employed in the process of this invention include brown coal, lignite, subbituminous, bituminous (high volatile, medium volatile, and low volatile), semi-anthracite, and anthracite. Regardless of the rank of the feed coal, excellent pyritic and organic sulfur removal can be achieved by the process of this invention. Metallurgical coals, and coals which can be processed to metallurgical coals, containing sulfur in too high a content, can be particularly benefited by the process of this invention.

In the first step of the process of this invention, coal particles are contacted with an aqueous solution of iron complexing agent and an oxidant such that at least a portion of the sulfur in the coal is oxidized.

The coal particles employed in this invention can be provided by a variety of known processes, for example, grinding or crushing.

The particle size of the coal can vary over wide ranges. In general the particles should be sufficiently small to enhance contacting with the aqueous medium. For instance, the coal may have an average particle size of one-fourth inch in diameter or larger in some instances, and as small as minus 200 mesh (Tyler Screen) or smaller. The rate of sulfur removal is faster the smaller the particle, but this advantage must be weighed against problems associated with obtaining and handling small particles. A very suitable particle size is often minus 5 mesh, preferably minus 18 mesh on 100 mesh as less effort is required for grinding and handling and yet the particles are sufficiently small to achieve an effective rate of sulfur removal.

The coal particles can be contacted with the aqueous solution of iron complexing agent by forming a mixture of the solution and coal particles. The mixture can be formed, for example, by grinding coal in the presence of water and adding a suitable amount of iron complexing agent and oxidant or an aqueous solution of iron complexing agent and/or oxidant can be added to coal particles of a suitable size. Preferably, the mixture contains from about 5 to about 50%, by weight of the mixture, coal particles and more preferably from about 10 to about 30%, by weight of the mixture, coal particles.

The iron complexing agents promote selective oxidation and removal of sulfur, and do not have a significant adverse effect on the coal.

The most suitable amount of iron complexing agent employed depends upon the pyrite and ash content of the coal, and the complexing agent employed. A mole ratio of complexing agent to pyrite of from about 0.05 to 10, and preferably 1.0 to 6.0, can be suitably employed. It is generally convenient to employ aqueous solutions of iron complexing agent which are from about 0.05 to about 1.0 molar, preferably 0.05 to 0.3 molar with respect to iron complexing agent.

Suitable iron complexing agents for use in this invention are compounds which can complex ferrous and/or ferric ions. Preferred complexing agents are compounds which can form ferrous complexes or ferric complexes having a stability constant of $-\log K$ greater than 1, and preferably greater than 2.0.

Convenient compilations providing stability constants of many complexing agents for iron are Martell and Calvin, "Chemistry of the Metal Chelate Compounds", U.S. copyright 1952, and "Stability Constants of Metal-Ion Complexes", supplement No. 1, Special Publication No. 25, published by The Chemical Society, U.S. copyright 1971.

Examples of suitable iron complexing agents include the following: carboxylic acids and carboxylic acid salts, including hydroxy carboxylic acids and salts for example, oxalic acid, malonic acid, succinic acid, citric acid, tartaric acid, lactic acid, gluconic acid, salicylic acid, and salts thereof; diols and polyols, for example, glycol, glycerine, butane-1,3 diol, mannitol, sorbitol, glucose, lactose, fructose and sucrose; amines, for example, ethylenediamine, for example, glycine, and asparagine and salts thereof; amino polycarboxylic acids and amino polycarboxylic acid salts, for example, N-hydroxyethyl-iminodiacetic acid, nitrilotriacetic acid, N,N-di(2-hydroxyethyl)glycine and N,N,N',N'-ethylene-diaminetetraacetic acid and salts thereof; phosphonic acids and phosphonic acid salts, for example, ethane-1-hydroxy-1, 1-diphosphonic acid; and condensed phosphates, for example, trimetaphosphoric acid, tripolyphosphoric acid and salts thereof. Especially suitable salt forms of iron complexing agents are the potassium, sodium and ammonium salts. Mixtures of complexing compounds can be very desirably employed.

As will be recognized by those skilled in the art, the stability of the ferrous and ferric complexes formed will often be affected by the pH of the aqueous medium. In such cases, it is contemplated that the pH will be such that a stability constant $-\log K$ greater than 1 is maintained and more preferably, the optimum iron complexing pH for the particular complexing agent will be maintained. For example, a pH of from about 4.0 to 7.0 is preferred when the complexing agent is oxalic acid, and its corresponding salts, for example, sodium, potassium and ammonium salts. The particular pH employed can also affect the salt form of the complexing agent employed, and such iron complexing salts are complexing agents within the scope of this invention.

Many of the complexing agents useful in the process of this invention can be very desirably formed in situ prior to or in the course of the process. For example, cellulosic materials can be oxidized to form a complex mixture of polyols, hydroxy carboxylic acids, carboxylic acids and corresponding acid salts which can provide a complexing solution meeting the requirements of this invention. (Any aqueous solution of complexing agents which complexes the iron in coal satisfies the requirements of this invention).

Oxalic acid salts, for example, sodium, potassium and ammonium oxalate are preferred complexing agents for use in the process of the invention in that they are effective complexing agents which are readily available and inexpensive.

Suitable oxidants for use in this invention are those oxidants which preferentially oxidize the sulfur contained in the coal rather than the carbon portion of the coal. By this is meant that the oxidation of sulfur atoms occurs without substantial oxidation of carbon atoms to form, for example, ketones, carboxylic acids or other carbonyl-containing compounds, carbon monoxide and carbon dioxide. This preferential oxidation, or selectivity is important if the heat content of the treated coal is to be substantially maintained.

Included among the oxidants which are useful herein are organic oxidants and inorganic oxidants.

The organic oxidants include by way of example hydrocarbon peroxides, hydrocarbon hydroperoxides and hydrocarbon peracids wherein the hydrocarbon radicals in general contain from about 1 to about 30 carbon atoms per active oxygen atom. With respect to the hydrocarbon peroxides and hydrocarbon hydroperoxides, it is particularly preferred that such hydrocarbon radical contain from about 4 to about 18 carbon atoms per active oxygen atom, i.e., per peroxide linkage, and more particularly from 4 to 16 carbon atoms per peroxide linkage. With respect to the hydrocarbon peracides, the hydrocarbon radical is defined as that radical which is attached to the carbonyl carbon and it is preferred that such hydrocarbon radical contain from 1 to about 12 carbon atoms, more preferably from 1 to about 8 carbon atoms, per active oxygen atom. It is contemplated within the scope of this invention that the organic oxidants can be prepared in situ.

Typical examples of organic oxidants are hydroxyheptyl peroxide, cyclohexanone peroxide, t-butyl peracetate, di-t-butyl diperphthalate, t-butyl-perbenzoate, methyl ethyl ketone peroxide, dicumyl peroxide, t-butyl hydroperoxide, di-t-butyl peroxide, pinane hydroperoxide, 2,5-dimethylhexane-2,5-dihydroperoxide, tetrahydronaphthalene hydroperoxide and cumene hydroperoxide as well as organic peracids, such as performic acid, peracetic acid, trichloroperacetic acid, perbenzoic acid and perphthalic acid.

Inorganic oxidants include by way of example, oxygen, singlet oxygen, ozone, peroxides and superoxides. Typical examples of inorganic peroxides are $H_2O_2$, $KMnO_4$, $KO_2$, $Na_2O_2$, and $Rb_2O_2$; typical examples of inorganic superoxides are $KO_2$, $RbO_2$, $CsO_2$, $Na_2SO_5$ and $Na_2S_2O_8$.

Oxygen is a preferred oxidant.

In general, the mole ratio of oxidant to sulfur is from about 0.5 to about 10 atoms of active (i.e., reduceable) oxygen per atom of sulfur. More or less oxidant could be employed, however. The most effective oxidation will generally occur when the mole ratio of oxidant to sulfur is greater than about 4, for example, when 5 to 10, atoms of active oxygen per atom of sulfur are present.

The preferred oxidant, oxygen, can be present as pure oxygen gas or it can be mixed with other inert gases. For example, air or air enriched with oxygen can be suitably employed as a source of gaseous oxygen. Preferably, the gaseous oxygen is above atmospheric pressure, for example, pressures of from about 5 to 500 psig., preferably 25 to 400 psig., and more preferably from about 50 to 300 psig. If the oxygen is mixed with other gases, the partial pressure of oxygen is most suitably within the pressure ranges mentioned hereinbefore.

Elevated temperatures can be desirably employed to accelerate the oxidation of sulfur. For example, temperatures of from about 150° to 500° F., preferably from about 150° to 400° F., and more preferably from about 175° to about 350° F., can be suitably employed. Under these reaction conditions, at least a portion of the sulfur in the coal (pyritic and organic sulfur) can be preferentially oxidized without significant adverse oxidation of the coal substrate.

The coal is held under these conditions for a period of time sufficient to preferentially oxidize at least a portion of the sulfur in the coal. The optimum time will depend upon the particular reaction conditions and the particular coal employed. Generally, a time period in the range of from about 5 minutes to 5 hours, or more, can be satisfactorily employed. Preferably, a time period of from 10 minutes to 2 hours is employed. During this time, it can be desirable to agitate the coal slurry. Known mechanical mixers, for example, can be employed to agitate the slurry.

The pyritic sulfur in coal can be oxidized under these conditions such that water soluble sulfur acids, for example, sulfuric acid, can be formed. If the pyritic sulfur content of the coal is high and a substantial amount of acid formed, it can often be necessary to add a basic material to obtain a desired pH. On the other hand, depending on the complexing agent, the character and content of ash in the complexing agent, the character and content of ash in the coal, it may be necessary to add an acidic material to obtain a desired pH.

It will be recognized by those skilled in the art that there are many ways to obtain a desired pH range in the aqueous slurry. For example, the pH of the slurry can be monitored using commercially available pH meters, and a suitable quantity of basic or acidic material can be metered to the slurry as needed to maintain the desired pH.

Another suitable method for obtaining a pH in the desired range involves adding an appropriate amount of basic or acidic material to the aqueous slurry of coal and water prior to subjecting the slurry to the reaction conditions involving increased temperature and pressure.

Examples of suitable basic materials include alkali and alkaline earth metal hydroxides such as sodium hydroxide, potassium hydroxide, calcium hydroxide, magnesium hydroxide and their corresponding oxides. Other suitable basic materials include alkali and alkaline earth carbonates, such as sodium carbonate, sodium bicarbonate, potassium bicarbonate, ammonia, ammonium bicarbonate and ammonium carbonate. Among these basic materials, sodium hydroxide, sodium carbonate, sodium bicarbonate, potassium bicarbonate, ammonium bicarbonate and mixtures thereof are preferred.

An especially suitable acidic material is carbon dioxide.

Materials which are buffering agents can be a very useful aid in maintaining the desired pH. An example of a suitable buffering agent is sodium acetate. As oxidation of the pyritic sulfur proceeds to generate sulfuric acid, part of the sodium acetate is converted to acetic acid to yield a buffer mixture, sodium acetate and acetic acid, is situ in the reactor. Control of pH within a very narrow range can be achieved using such a buffering agent. Other buffering agents for maintaining a desired pH are known to those skilled in the art.

It will be recognized by those skilled in the art that many complexing agents suitable for use in the process of this invention are also buffering agents. For example, many carboxylic acid salts and aminocarboxylic acid salts can find use as both complexing agents and buffering agents in the process. (As will be recognized by those skilled in the art, depending upon the pH such complexing/buffering agents will be present as a mixture of acid and salt forms). Oxalic acid salts, for example, sodium, potassium and ammonium oxalate are illustrative of preferred complexing/buffering agents employed in the process of this invention.

The most suitable basic materials for maintaining the pH of the aqueous solution in the process are those having cations which form soluble salts with sulfur-oxygen anions such as thiosulfate, sulfate and thionate. The most suitable basic materials have cations comprising sodium, ammonium and/or potassium since such materials are readily available and form water soluble materials with sulfate.

When coal particles are contacted with the aqueous solution of iron complexing agent and oxidant in the first step of this process, some sulfur (primarily pyritic sulfur) can be oxidized to form water soluble sulfur compounds, for example, water soluble sulfate salts. The result is that the sulfur content of the coal can often be diminished in the course of the first step of the process of this invention. If desired, substantially all of the pyritic sulfur can be removed from the coal in this first step. This is not always necessary, however, since substantial pyritic sulfur removal also occurs in the second step of the process. Following the oxidation, the oxidized sulfur-containing coal may be separated from the aqueous solution of iron complexing agent, and products of the process produced in the first oxidation step. As noted, some sulfur-containing compounds may be removed at this point. This separation may be performed using conventional procedures, such as filtering with bar sieves or screens, centrifuging or agglomeration of the coal particles with a suitable binder, e.g., oil.

In the second step of the process of this invention the oxidized-sulfur-containing coal is contacted with at least one component, e.g., hydrocarbon hydrogen donor, capable of transferring hydrogen to the oxidized sulfur-containing coal. The ratio of oxidized sulfur-containing coal to hydrogen donor may vary over a broad range. For example, for each part of the coal from about 0.2 parts to about 10 parts of hydrogen donor material may be used. However, in order to obtain the maximum benefits of the present invention, it is preferred to use from about 0.5 parts to about 2 parts hydrogen donor material for each part of the oxidized sulfur-containing coal.

The above-noted contacting takes place at conditions such that hydrogen is transferred from at least a portion of said hydrogen donor material to the oxidized sulfur-containing coal. While carrying out this contacting step, it is preferred to maintain a sufficient pressure in the contacting zone so as to maintain a major portion of the hydrogen donor material in the liquid phase. Typical contacting pressures may be within the range from about atmospheric pressure to about 2000 psig., preferably from about 300 psig. to about 1000 psig. Contacting time may range from about 2 minutes to about 8 hours, preferably from about 10 minutes to about 2 hours. Suitable contacting temperatures may range, for example, from about 550° F. to about 900° F., preferably from about 650° F. to about 800° F.

The hydrogen donor material may be any component or mixture of components which is capable of transferring hydrogen to the oxidized sulfur-containing coal at the conditions of the contacting step described above. Included among the suitable hydrogen donor materials are mixed naphthenic-aromatic condensed ring compounds having up to about 40 carbon atoms per molecule, such as indane, $C_{10}$ to $C_{12}$ tetralins, decalin, ditetra-, and octa-hydroanthracene, $C_{12}$ and $C_{13}$ acenaphthenes, tetra-hydroacenaphthene as well as partially hydrogenated condensed aromatic ring compounds such as anthracene, chrysene, benzopyrene fluorenthene, phenanthrene, pyrene and triphenylene, benzoanthracene, benzophenanthrene and the like; aromatic compounds containing from about 13 to about 26 carbon atoms per molecule and having al least one alkyl substituent containing from about 7 to about 20 carbon atoms, such as cumene, di-isopropyl benzene, butyl benzene, octyl benzene, decyl benzene and the like; cycloparaffins containing from about 3 to about 15 carbon atoms per molecule and alkyl derivatives of said cycloparaffins containing at least one alkyl group having from 1 to about 15 carbon atoms such as cyclohexane, cyclopentane, cyclooctane, methyl cyclohexane, diethyl cyclohexane, methyl cyclododecane, tertiary butyl cyclohexane and the like. Mixtures of more than one of these components may be used as the hydrogen donor material. In addition, mixtures of components, e.g., petroleum refinery streams such as hydrotreated cycle or clarified oil and the like, which contain a significant amount of hydrogen donor material may be employed in the above-described contacting step.

Because of the economic considerations, availability and processing efficiency, the preferred hydrogen donor materials for use in the present invention include indane, $C_{10}$ to $C_{12}$ tetralins, decaline, di-, tetra-, and octa-hydroanthracene, $C_{12}$ and $C_{13}$ acenaphthenes, tetrahydroacenaphthene, partially hydrogenated anthracene, partially hydrogenated phenanthrene, partially hydrogenated pyrene and mixtures thereof. For example, an available synthetic recycle solvent consisting of 43% tetralin, 38% 2-methyl naphthalene, 17% P-cresol, and 2% 4-picoline can be suitably employed. More preferred hydrogen donor materials include the above-noted partially hydrogenated condensed aromatic ring compounds, especially the above-noted tetralins.

Some useful hydrogen donor materials possess the ability to dissolve certain fractions of coal solids. This does not lessen the usefulness of such materials in the process. The fraction of the coal which is dissolved has good heating value and is reduced in sulfur, and the fraction of the coal not dissolved has heating value and is reduced in sulfur. In fact liquid fuel products can be quite desirable. An example of a hydrogen donor material which can dissolve some coal solids is tetralin.

The process step whereby the oxidized sulfur-containing coal is contacted with at least one component capable of transferring hydrogen may be carried out in any conventional manner, e.g., batchwise, semi-batchwise or continuously. Conventional equipment, such as, stirred tanks, agitated or stirred autoclaves, heat exchanges, fired heaters and the like, can be employed in performing this contacting step.

This contacting step causes at least a portion of the sulfur in the oxidized sulfur-containing coal to form compounds which can be removed by conventional techniques, e.g., flashing, distillation, to give a coal product having reduced sulfur content. For example, after the contacting step, a mixture comprising coal product reduced in sulfur content and at least partially dehydrogenated hydrogen donor material can be separated from volatile sulfur-containing compounds formed in the contacting step by conventional operations such as flashing and stripping. With the separation of such sulfur-containing compounds, the third step of the process of the invention is completed, i.e., a coal product of reduced sulfur content is recovered. The recovered coal product (liquid coal and coal solids) can be admixed with the at least partially dehydrogenated hydrogen donor material.

If desired, the coal solids of reduced sulfur content may be separated from coal liquids of reduced sulfur content and the at least partially dehydrogenated hydrogen donor material by known methods, for example, centrifuging or filtering. In the processing procedure, it may be desirable to conventionally remove sulfur-containing compounds from the used hydrogen donor material. Whatever procedure is used, the above-noted contacting step provides a coal product of reduced sulfur content.

One beneficial modification of the present invention involves the hydrogenation of the dehydrogenated hydrogen donor material followed by recycle back to the above-described contacting step. In this regard, it should be noted that coal liquids, for example, coal liquids provided by contacting coal with a solvent such as tetralin can be a suitable hydrogen donor material, especially, where the coal liquid is hydrogenated and recycled back to the contacting step in the process. If this is done, coal can be substantially the only hydrocarbon which need by employed in the process.

The hydrogenation operation may be performed using conventional procedures. The hydrogenation is normally performed in the presence of a catalyst and may take place in either the liquid, vapor or combined liquid vapor phases. Typical hydrogenation catalysts for use in this invention include catalysts comprising a minor amount of at least one Group IV to Group VIII metal, present as elemental metal, as a metal salt, for example, oxide, sulfide and the like, or as mixtures thereof, supported on a catalyst carrier such as silica, silica-alumina, alumina, activated clays, carbon and the like. The hydrogenation operation may be either batch, semi-batch or continuous, with continuous being preferred. Reaction temperatures within the range from about 50° C. to about 400° C. are suitable while pressure ranging from about 0 psig. to about 1000 psig., or more may be used. Hydrogen to partially dehydrogenated hydrogen donor material mole ratios may range from less than about 1 to about 10 or more. Weight hourly space velocities ranging from about 0.1 to about 100 may be used. The hydrogenation conditions may vary over a broad range depending upon the extent of hydrogenation desired, the particular material being hydrogenated, the catalyst being used and the like reaction parameters.

All parts, percentages and proportion herein are on a weight basis unless otherwise specified.

The following examples illustrate more clearly the process of the present invention. However, these illustrations are not to be interpreted as specific limitations on the invention.

EXAMPLE 1

Illinois #6 coal was ground and screened to provide a quantity of coal having a particle size of 100 × 0 mesh. The feed coal had the following analysis:

| Percent by Weight | Dry Basis | Dry Ash Free Basis |
|---|---|---|
| Sulfate sulfur | 0.06% | 0.07% |
| Pyritic sulfur | 1.17% | 1.29% |
| Organic sulfur | 2.31% | 2.55% |
| Total sulfur | 3.54% | 3.91% |
| Ash | 9.45% | |

The coal was treated in the following manner to reduce the sulfur content.

First Step

The coal was treated in the following manner to preferentially oxidize at least a portion of the sulfur in the coal. A slurry of this coal and an aqueous solution of iron complexing agent (0.2M sodium oxalate) was formed such that the resulting slurry contained 13%, by weight coal. This slurry was charged to an autoclave. The autoclave was sealed and then heated to 250° F.; oxygen was then introduced to the autoclave and maintained at a pressure of 300 psig. $O_2$. The coal was held under these conditions for 1 hour. In the course of the reaction, additional sodium oxalate solution was added as needed to maintain a pH of from 4.0 to 5.5. The autoclave was then cooled and excess oxygen released. The contents of the autoclave were then filtered to separate the coal and the aqueous solution. The separated coal product was thoroughly washed with warm water. About 95% of the pyritic sulfur was removed in this step.

Second Step

Twenty-seven grams of the oxidized sulfur-containing coal obtained in the first step and 97 grams of tetralin, a hydrogen donor material, were charged to a suitable reaction vessel. This mixture was heated, in the absence of oxygen, to a temperature of 700° F., and held at this temperature at autogeneous pressure for one hour. The vessel was then cooled and emptied. The mixture was separated into a solid fraction and a liquid fraction. The tetralin was removed from the liquid fraction by distillation leaving 5.6 grams of coal liquids. (The more volatile coal liquids remained with the tetralin).

The two coal fractions, 17.9 grams coal solids and 5.6 grams coal liquids, were then analyzed for sulfur. The results were as follows:

| | Percent by Weight Dry Ash Free Basis | | |
|---|---|---|---|
| | Organic Sulfur | Pyritic Sulfur | Sulfate Sulfur |
| Coal solids | 1.78 | 0.00 | 0.09 |
| Coal liquids | 1.31 | 0.00 | 0.00 |

As can be seen, the resulting coal products are substantially reduced in organic sulfur content.

In this Example, it has been noted that if the feed coal is subjected to the treatment of the Second Step without the treatment of the First Step that substantially less organic sulfur removal is effected.

EXAMPLE II

When in Example I one of the following complexing agents is employed instead of sodium oxalate, the same or similar results are obtained in that the sulfur content of the coal is reduced: potassium oxalate, ammonium oxalate, sodium glycinate, sodium ethylenediamine tetracetic acid, sodium N,N-di (2-hydroxyethyl)glycine, dextrose ethylenediamine, and sodium tripolyphosphate.

EXAMPLE III

When in Example I, First Step, the aqueous solution contains 0.2M of an oxidant selected from the group consisting of peracetic acid, hydrogen peroxide or potassium superoxide instead of oxygen, the same or similar results are obtained in that the sulfur content of the coal is reduced.

EXAMPLE IV

When in Example I, Step Two, the hydrogen donor is indane, decaline, di-, tetra-, and octa-hydroanthracene, $C_{12}$ and $C_{13}$ acenaphthenes, tetrahydroacenaphthene, partially hydrogenated anthracene, partially hydrogenated phenanthrene, partially hydrogenated pyrene and mixtures thereof instead of tetralin, the same or similar results are obtained in that the sulfur content of the coal is reduced.

While this invention has been described with respect to various specific examples and embodiments, it is to be understood that the invention is not limited thereto and that it can be variously practiced within the scope of the following claims.

What is claimed is:

1. A process for reducing the sulfur content of coal comprising the steps of:

(1) contacting coal particles with an aqueous solution of iron complexing agent, and an oxidant to preferentially oxidize at least a portion of the sulfur in the coal;

(2) contacting the oxidized sulfur-containing coal with at least one hydrogen donor material capable of transferring hydrogen to the oxidized sulfur-containing coal under conditions such that hydrogen transfer occurs; and (3) recovering coal particles of reduced sulfur content.

2. The process of claim 1 wherein the aqueous solution of iron complexing agent is maintained at elevated temperature.

3. The process of claim 2 wherein the oxidant is oxygen.

4. The process of claim 3 wherein the oxygen is maintained at a pressure of from 5 to 500 psig.

5. The process of claim 4 wherein the aqueous solution of iron complexing agent is maintained at an elevated temperature from about 150° to 400° F.

6. The process of claim 5 wherein the iron complexing agent is present in a mole ratio of iron complexing agent to pyrite of 0.05 to 10.

7. The process of claim 6 wherein the iron complexing agent is a compound which forms ferrous or ferric complexes having a stability constant $-\log K$ of more than 1.

8. The process of claim 7 wherein the stability constant $-\log K$ is greater than 2.

9. The process of claim 8 wherein the pressure of oxygen is from about 25 to 400 psig.

10. The process of claim 9 wherein the pressure of oxygen is from about 50 to 300 psig.

11. The process of claim 10 wherein the temperature is from about 175° to 350° F.

12. The process of claim 11 wherein the complexing agent is selected from the group consisting of carboxylic acids and carboxylic acid salts, diols and polyols, amines, amino acids and amino acid salts, amino polycarboxylic acids and amino polycarboxylic acid salts, phosphonic acids and phosphonic acid salts, condensed phosphates, and salts of condensed phosphates.

13. The process of claim 12 wherein the salts are alkali metal and ammonium salts.

14. The process of claim 13 wherein the complexing agent is selected from the group consisting of sodium oxalate, potassium oxalate and ammonium oxalate.

15. The process of claim 2 wherein the oxidant is selected from the group consisting of ozone and singlet oxygen.

16. The process of claim 2 wherein the oxidant is an organic oxidant selected from the group consisting of hydrocarbon peroxides, hydrocarbon hydroperoxides and hydrocarbon peracids.

17. The process of claim 2 wherein the oxidant is an inorganic oxidant selected from the group consisting of peroxides and superoxides.

18. The process of claim 1 wherein the hydrogen donor material is a hydrocarbon hydrogen donor material.

19. The process of claim 18 wherein the hydrocarbon hydrogen donor material is selected from the group consisting of mixed naphthenic-aromatic condensed ring compounds having up to about 40 carbon atoms per molecule, aromatic compounds containing from about 13 to about 26 carbon atoms per mole and having at least one alkyl substituent having from about 7 to about 20 carbon atoms, cyclo-paraffins containing from about 3 to about 15 carbon atoms per molecule, alkyl derivatives of said cycloparaffins containing at least one alkyl group having from 1 to about 15 carbon atoms and mixtures thereof.

20. The process of claim 19 wherein the hydrocarbon hydrogen donor material is selected from the group consisting of indane, $C_{10}$ to $C_{12}$ tetralins, decalin, di-, tetra-, and octahydroanthracene, $C_{12}$ and $C_{13}$ acenaphthenes, tetrahydroacenaphthene, partially hydrogenated anthracene, partially hydrogenated phenanthrene, partially hydrogenated pyrene and mixtures thereof.

21. The process of claim 18 wherein hydrogen transfer conditions include a temperature of from about 550° to about 900° F.

22. The process of claim 21 wherein the contacting is for a period of from about 2 minutes to about 8 hours.

23. The process of claim 22 wherein the contacting is for a period of from about 10 minutes to about 2 hours.

* * * * *